US007177563B2

(12) United States Patent
Sone et al.

(10) Patent No.: US 7,177,563 B2
(45) Date of Patent: Feb. 13, 2007

(54) APPARATUS FOR FIXING TONER ON TRANSFERRED MATERIAL

(75) Inventors: Toshihiro Sone, Yokohama (JP); Osamu Takagi, Chofu (JP); Satoshi Kinouchi, Tokyo (JP); Yoshinori Tsueda, Fuji (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 63 days.

(21) Appl. No.: 10/944,707

(22) Filed: Sep. 21, 2004

(65) Prior Publication Data

US 2006/0062585 A1 Mar. 23, 2006

(51) Int. Cl.
*G03G 15/20* (2006.01)

(52) U.S. Cl. ..... 399/69; 399/334; 399/330

(58) Field of Classification Search ..... 399/44, 399/67, 69, 70, 94, 320, 328, 330, 334
See application file for complete search history.

(56) References Cited

U.S. PATENT DOCUMENTS

| | | | | |
|---|---|---|---|---|
| 5,819,136 | A | 10/1998 | Tomita et al. | |
| 6,724,999 | B2 * | 4/2004 | Kikuchi et al. | 399/69 |
| 6,871,041 | B2 | 3/2005 | Takagi et al. | |
| 2004/0175211 | A1 | 9/2004 | Sone et al. | |
| 2004/0175212 | A1 | 9/2004 | Tsueda et al. | |
| 2004/0238531 | A1 | 12/2004 | Kikuchi et al. | |
| 2004/0265021 | A1 | 12/2004 | Kinouchi et al. | |
| 2005/0008413 | A1 | 1/2005 | Takagi et al. | |

FOREIGN PATENT DOCUMENTS

| | | | |
|---|---|---|---|
| JP | 10-31390 A | | 2/1998 |
| JP | 2001034109 | * | 2/2001 |
| JP | 2003-229242 A | | 8/2003 |

OTHER PUBLICATIONS

U.S. Appl. No. 10/805,305, filed Mar. 22, 2004, Sone et al.
U.S. Appl. No. 10/805,308, filed Mar. 22, 2004, Tsueda et al.
U.S. Appl. No. 10/805,420, filed Mar. 22, 2004, Sone et al.
U.S. Appl. No. 10/805,514, filed Mar. 22, 2004, Kinouchi et al.
U.S. Appl. No. 10/820,138, filed Apr. 8, 2004, Sone et al.
U.S. Appl. No. 10/945,395, filed Sep. 21, 2004, Kinouchi et al.
U.S. Appl. No. 10/944,855, filed Sep. 21, 2004, Sone et al.

* cited by examiner

*Primary Examiner*—Hoang Ngo
(74) *Attorney, Agent, or Firm*—Foley & Lardner LLP

(57) ABSTRACT

The present invention relates to a temperature detection apparatus having a radiant temperature detection section including at least a ray emission portion which radiates at least rays and a ray detection portion which detects the rays, and capable of detecting temperature without contacting a detection object, a first atmospheric temperature detection section which outputs temperature information having a high temperature follow-up property in a case where the atmospheric temperature of the radiant temperature detection section is not more than predetermined temperature, and a second atmospheric temperature detection section which outputs temperature information having a high temperature follow-up property in a case where the atmospheric temperature of the radiant temperature detection section exceeds the predetermined temperature.

18 Claims, 6 Drawing Sheets

APPARATUS FOR FIXING TONER ON TRANSFERRED MATERIAL

BACKGROUND OF THE INVENTION

1. Field of the Invention

The present invention relates particularly to a fixing apparatus which is usable in image forming apparatuses such as a copying apparatus and a printer apparatus in an electrophotographic system using a thermally melting developer and which fixes a developer to an output object.

2. Description of the Related Art

A fixing apparatus incorporated in an image forming apparatus using an electrophotographic process applies heat to a toner (developer) positioned on an output object, that is, a recording material to soften the toner, and applies pressure to the toner to fix the toner to the recording material. In recent years, induction heating has been broadly utilized as a heating system capable of reducing a time from when power supply is started until temperature reaches fixable temperature at which the toner softens, that is, heating time.

However, in the fixing apparatus using the induction heating, it is difficult to correctly detect the temperature of a heat roller (heating member) for fixing the toner to the recording material.

There have been many proposals in order to improve these respects.

For example, it has been described in Japanese Patent Application Laid-Open No. 2003-229242 that an apparatus (fixing apparatus) for heating a heating object member by the induction heating has an optical system and a mirror for guiding infrared rays radiated from a heating object member to infrared-ray detection means, and power to be supplied to heating means for heating the heating object member is controlled based on the detected infrared rays.

For example, it has been described in Jpn. Pat. Appln. KOKAI Publication No. 10-31390 that in a fixing apparatus for an electrophotographic apparatus having non-contact temperature detection means having self temperature detection means, the temperature of a heat roller is obtained from temperatures by a multidimensional equation using the self temperature detected by the self temperature detection means and the temperature in the vicinity of the heat roller detected by the non-contact temperature detection means.

For example, it has been proposed in U.S. Pat. No. 5,819,136 that in the fixing apparatus of the image forming apparatus, an air current is generated toward the fixing apparatus, and the temperature of the fixing apparatus is controlled based on the temperature detected using the non-contact temperature detection means disposed in a region where the air current passes.

However, even by the proposal of any of the above-described documents, it has been difficult to correctly detect the temperature of the heating member (heat roller) within a slight temperature management width.

BRIEF SUMMARY OF THE INVENTION

An object of the present invention is to provide a fixing apparatus capable of correctly detecting temperature of a heating object, and stably fixing a toner to a recording material in a constant condition range.

According to the present invention, there is provided a heating apparatus comprising:

a heating member to which energy is supplied to generate heat and to thereby heat a recording material and a developer;

a plurality of heating mechanisms which supply the energy to the heating member and which are disposed in association with a longitudinal direction of the heating member and which selectively allow the heating member to generate the heat in accordance with temperature distribution of the heating member in the longitudinal direction; and a plurality of temperature detection mechanisms including a plurality of radiated heat detection sections which detect the radiated heat reflected from the heating member without contacting the heating member and a plurality of temperature detection sections which detect ambient temperature of the radiated heat detection section, the plurality of temperature detection mechanisms being disposed using a region in which the heating member generates the heat as a unit.

Moreover, according to the present invention, there is provided a fixing apparatus comprising:

a heating member to which a magnetic field is supplied to generate heat and to thereby heat a recording material and a developer;

a plurality of first and second coil members which supply the magnetic field to the heating member to generate induction heat and which are disposed in a longitudinal direction of the heating member and which are capable of independently supplying the magnetic field;

a plurality of temperature detection mechanisms including a plurality of radiated heat detection sections which detect the radiated heat reflected from the heating member without contacting the heating member and a plurality of temperature detection sections which detect ambient temperature of the radiated heat detection section, the plurality of temperature detection mechanisms being disposed using a region in which the heating member generates the heat as a unit; and a pressure supplying member which is brought into contact with the heating member in a predetermined position and which fixes the developer to the recording material passed between the pressure supplying member and the heating member.

Furthermore, according to the present invention, there is provided a temperature detection apparatus comprising:

a radiant temperature detection section including at least a ray emission portion which radiates at least rays and a ray detection portion which detects the rays, and capable of detecting temperature without contacting a detection object;

a first atmospheric temperature detection section which detects atmospheric temperature of the radiant temperature detection section and which outputs temperature information having a high temperature follow-up property in a case where the atmospheric temperature is not more than predetermined temperature; and a second atmospheric temperature detection section which detects the atmospheric temperature of the radiant temperature detection section and which outputs temperature information having a high temperature follow-up property in a case where the atmospheric temperature exceeds the predetermined temperature.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be described hereinafter with reference to the drawings.

Figure 1:
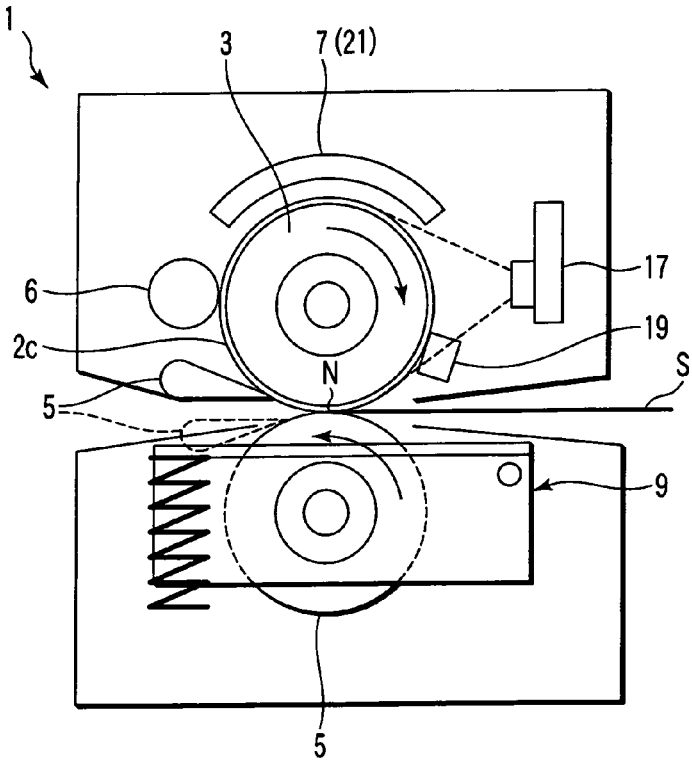
FIG. 1 is a schematic drawing showing one example of a fixing apparatus to which an embodiment of the present invention is applied.

FIG. 1 shows a fixing apparatus to be incorporated in image forming apparatuses such as a copying apparatus and a printer apparatus for fixing a thermally melting developer to a sheet-like output medium to obtain a hard copy, that is, a printing output.

The fixing apparatus has been broadly utilized for fixing a toner (developer) to the sheet-like output medium to obtain the printing output. Examples of the sheet-like output medium include paper, resin sheet and the like. The developer (toner) is electrostatically held by the sheet-like output medium. The fixing apparatus applies heat to the toner and the sheet-like output medium to soften the toner, and applies a predetermined pressure in such a manner as to fix the toner to the medium.

A fixing apparatus 1 has a heat roller 3, a press roller 5, and a heating device 7 of an induction heating system. Axial lines of the heat roller 3 and the press roller 5 are parallel to each other.

The pressure is supplied to the press roller 5 by a pressurizing mechanism (spring and roller holding structure) 9, and accordingly the press roller is pressed onto the heat roller 3. Various known structures are usable in the spring and roller holding structure as long as the press roller 5 can be pressed onto the heat roller 3 with a predetermined pressure.

An outer peripheral portion of the press roller 5 deforms based on the pressure supplied from the pressurizing mechanism 9. A deformed region is referred to as a nip N. The nip N has a predetermined width which is a length of an outer peripheral surface of the rollers 3 and 5. An outer diameter and material of the press roller 5, pressure during the pressing onto the heat roller 3, outer diameter and hardness of the heat roller 3 and the like are appropriately set in such a manner that the width of the nip N falls in a constant range.

A claw 11 is disposed in a predetermined position defined on a downstream side from the nip N along an outer periphery of the heat roller 3 during rotation of the heat roller. The claw 11 is used for releasing (peeling) a sheet (sheet-like medium) S from adhesion of the sheet S to the surface of the heat roller 3 caused by curving (of the sheet S) on the side of the surface of the heat roller. The adhesion is caused by curl of the sheet S itself by fusion bonding of the surface of the heat roller 3 to the toner on the sheet S, or application of the heat.

A plurality of claws 11 may be disposed while associated with intensity of the fusion bonding of the sheet S to the surface of the heat roller 3 or degree of curvature of the sheet S on the side of the roller surface, that is, peelability. The claw 11 may be omitted in a case where the peelability (of the sheet S) is high. The claw 11 may be disposed on the outer periphery of the press roller 5 in a positional relation similar to that with respect to the heat roller 3.

A cleaning roller 13 and/or an oil (coat) roller 15 is disposed in a predetermined position around either or both of the heat roller 3 and the press roller 5. The cleaning roller 13 is used in removing a toner, dust (especially particulates generated from the sheet S) and the like sometimes sticking to the surfaces of the heat roller 3 and the press roller 5. The oil (coat) roller 15 prevents the toner from being fixed to the surfaces of the heat roller 3 and the press roller 5 and/or supplies oil to the surface of the corresponding roller for a purpose of enhancing the peelability of the sheet S described above. The oil is, for example, preferably silicone based.

Non-contact temperature detection means (temperature detection mechanism) 17 and safety device 19 are disposed in predetermined positions in the vicinity of either or both of the heat roller 3 and the press roller 5. The temperature detection mechanism 17 and the safety device 19 are disposed in the positions which are not influenced by a magnetic flux (line of magnetic force) generated from the heating device 7. The temperature detection mechanism 17 detects the temperature of the surface of the heat roller 3. The temperature detection mechanism 17 is a temperature sensor (non-contact), for example, of a thermopile type. The temperature detection mechanism 17 may include, for example, a thermistor of a contact type. At least two temperature detection mechanisms 17 are disposed at a predetermined interval in a longitudinal direction of the heat roller 3.

The temperature detection mechanism 17 is disposed, for example, on an arbitrary surface including an axis of the heat roller 3 when viewed in a peripheral direction (direction of a plane crossing the axis at right angles) of the heat roller 3. The temperature detection mechanism 17 may be disposed in an arbitrary position, for example, in the vicinity of the nip N (upstream of a rotation direction of the heat roller 3) or the heating device 7 (space between the heating device 7 and the heat roller 3), when viewed from the peripheral direction (direction of the plane crossing the axis at right angles) of the heat roller 3. The temperature detection mechanism 17 is capable of detecting, for example, the temperature of the space between the heat roller 3 and the heating device 7 and the temperature around the heat roller 3 in the vicinity of the nip N, that is, temperatures in a plurality of positions in the peripheral direction of the heat roller 3, when viewed in the peripheral direction (direction of the plane crossing the axis at right angles) of the heat roller 3. The safety device 19 is, for example, a thermostat. The thermostat 19 stops an operation of the heating device 7, that is, an output of an induced current in a case where the temperature of the surface of the heat roller 3 rises at a temperature which has not been expected. The rise of the temperature of the surface of the heat roller 3 at the unexpected temperature is caused, for example, by abnormality (burnout/damage) of the temperature detection mechanism 17.

The heat roller 3 has a metal conductive layer 3*a* which generates heat by eddy current generated by the magnetic field (line of magnetic force) supplied by the heating device 7, and is formed, for example, into a tube or rod shape. The heat roller 3 is rotated in an arrow direction centering on an inherent axial line (not shown) by a rotating force supplied by a motor (not shown) or a power transmission mechanism. The outer peripheral surface of the heat roller 3 is moved at a predetermined speed [mm/second] (the heat roller 3 is rotated at a predetermined rotation number, and the speed at which the outer peripheral surface is moved can therefore be obtained from the rotation number). An elastic layer and/or a mold release layer capable of reducing a remaining toner and the like are disposed on the outer peripheral surface of the heat roller 3.

The press roller 5 is brought into contact with the outer periphery of the heat roller 3 via the nip N. Therefore, when the heat roller is rotated, the press roller is rotated in an arrow direction at the predetermined rotation number. The outer peripheral surface of the press roller 5 is moved at a predetermined movement speed [mm/second].

The heating device 7 has a coil 21 which supplies a magnetic field having a predetermined intensity to the metal conductive layer 3*a* of the heat roller 3. The coil 21 is wound around a core 23 formed of a magnetic material by the predetermined number of windings, and is formed into a predetermined shape. The coil 21 (heating device 7) may be disposed inside the heat roller 3, when the heat roller 3 is tubular (hollow).

Figure 2:
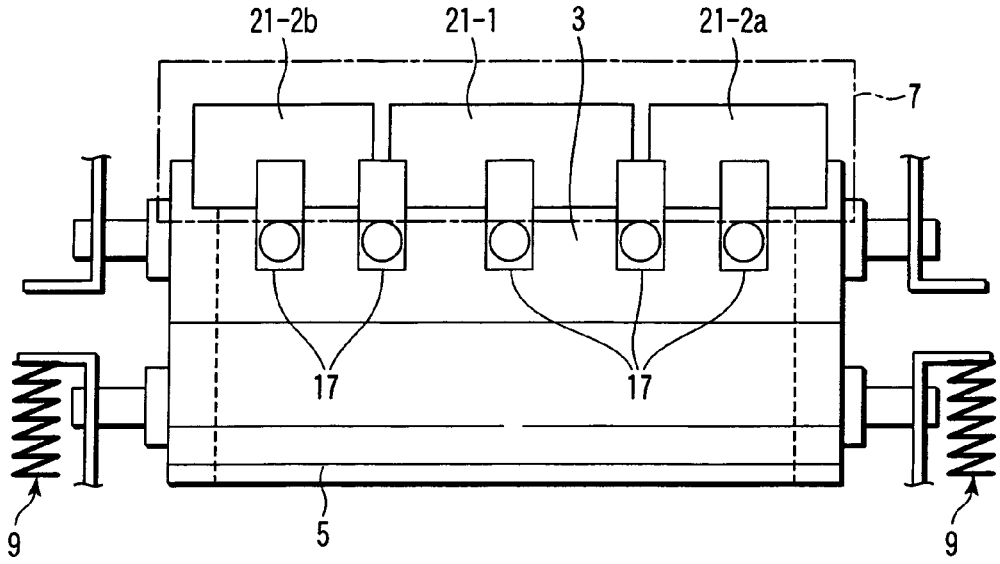
FIG. 2 is a schematic diagram showing an example of a heating apparatus incorporated in the fixing apparatus shown in FIG. 1.

As shown in FIG. 2, the coil 21 is divided, for example, into three along the longitudinal direction of the heat roller 3. Cores are disposed for coils, although not described in detail. When the coil 21 is divided into three, the coil positioned in a middle of heat roller 3 in the longitudinal direction is formed to be electrically equivalent to two coils positioned in opposite ends. When the coil 21 is divided into three, the coil positioned in the middle of the heat roller 3 in the longitudinal direction is referred to as a first coil 21-1. The coils positioned on opposite sides (end portions of the roller 3 in the longitudinal direction) of the first coil 21-1 with respect to the longitudinal direction of the heat roller 3 are referred to as second coils 21-2. When one of the second coils is identified, they are referred to as a first end coil 21-2*a*, second end coil 21-2*b*. The first end coil 21-2*a* of the second coil is electrically connected to the second end coil 21-2*b* in series. The coils other than the first coil 21-1 are operated under the same control.

A size of the first coil 21-1 is defined in such a manner that a length of the sheet in contact with the heat roller 3 can be heated in a case where the sheet S has an at least A4 size and a short side of the sheet S is conveyed in a direction crossing a conveying direction of the sheet S at right angles during the conveying. When a region (width) of the sheet S contacting the heat roller is small as compared with the length of the heat roller 3, power can be supplied only to the middle (first) coil 21-1 in such a manner that the only region corresponding to the contact width of the sheet S can be heated. Since the coil 21 is divided into the middle (first) coil 21-1 and the opposite end (second) coils 21-2, temperature distribution of the heat roller 3 in the longitudinal direction can be uniformed.

In the image forming apparatus using the fixing apparatus, when the toner is passed through the nip N, that is, a fixing point together with the sheet S, the toner is heated by the heat supplied from the heat roller 3 to soften (the toner is electrostatically positioned on the sheet S as an image to be fixed onto the sheet S). The softened toner receives a predetermined pressure from the heat roller 3 and the press roller 5 in the nip N. By the above-described steps, the toner, that is, an image to be output is fixed onto the sheet S.

Next, a "position" in which the temperature detection mechanism 17 is to be disposed will be described.

Figure 3:
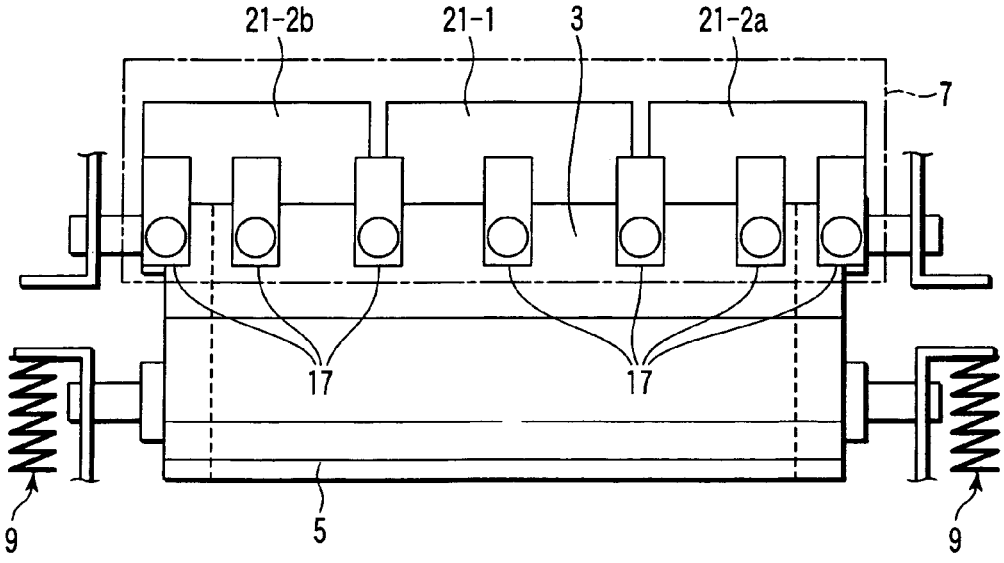
FIG. 3 is a schematic diagram showing another example of the heating apparatus shown in FIG. 2.

The temperature detection mechanism (temperature sensor of the thermopile type) 17 is disposed in association with three divided individual coil spaces with respect to the longitudinal direction of the heat roller 3 shown, for example, in FIG. 2. As to the thermopile type temperature sensor 17, at least two sensors are disposed between the first coil 21-1 and the first end coil 21-2*a* and between the first coil 21-1 and the second end coil 21-2*b* in a projected state along the axis of the heat roller 3. As to the thermopile type temperature sensor 17, preferably three sensors are disposed in a region most heated by the first (middle) coil 21-1, and regions most heated by the second coils 21-2*a* and 21-2*b* with respect to the longitudinal direction of the heat roller 3. Adding the above-described two sensors, five sensors are disposed in total. More thermopile type temperature sensors 17 may be prepared with respect to the longitudinal direction of the heat roller 3. For example, as shown in FIG. 3, when the second coils 21-2 are formed to be long in such a manner as to cover the opposite ends of the heat roller 3, another coil is disposed in each of the opposite ends of the second coils 21-2. Adding the above-described five sensors, seven sensors are disposed.

The thermopile type temperature sensors 17 are positioned in the divided regions on the side of the heat roller 3, when the sheet S is passed through the nip N in a display by a plane (the same direction as that of FIG. 1) crossing the axis of the heat roller 3 at right angles, that is, in a state in which the sensors are viewed in the same direction as that of FIG. 1. Since the thermopile type temperature sensors 17 are arranged in the above-described positions, the temperature of the space between any of the first coil 21-1, first end coil 21-2*a*, and second end coil 21-2*b* and the surface of the heat roller 3 is detectable. Since the thermopile type temperature sensors 17 are arranged in the above-described positions, the temperature of the surface of the heat roller 3 in the vicinity of the nip N is detectable.

Next, a constitution of the thermopile type temperature sensor (temperature detection mechanism) 17 will be described.

As apparent from FIG. 2, a plurality of thermopile type temperature sensors 17 are arranged in a longitudinal direction of the heat roller 3, but have the same structure.

Figure 4:
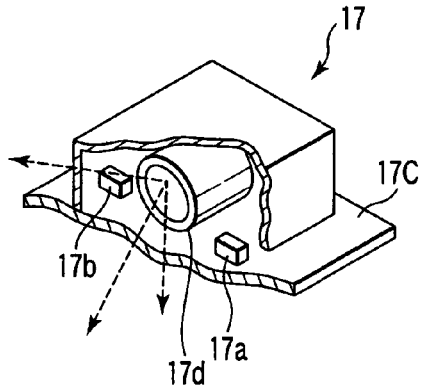
FIG. 4 is a schematic diagram showing one example of a temperature detection mechanism (non-contact) incorporated in the fixing apparatus shown in FIG. 1.

As shown in FIG. 4, the thermopile type temperature sensor 17 includes first and second ambient temperature detection portions 17*a*, 17*b* which detect ambient (atmospheric) temperature to inform the temperature in accordance with a predetermined rule (interface/protocol), and a substrate portion 17*c* which holds the respective detection portions.

In the substrate portion 17*c*, an ASIC portion including a thermopile portion 17*d* and an output circuit element which is not described in detail herein is integrally disposed. The thermopile portion 17*d* has an infrared-ray radiant portion which radiates infrared rays toward a temperature detection object, that is, the surface of the heat roller 3, and an infrared-ray detection portion which detects the infrared rays detected by the surface of the heat roller 3. A radiant quantity of infrared rays radiated in the thermopile portion 17*d* can be optionally set. This is useful for enhancing precision of detected temperature in a case where the quantity of the infrared rays reflected by the surface of the heat roller 3 fluctuates due to changes of reflectance of the surface of the heat roller 3. The thermopile type temperature sensor detects the infrared rays radiated from the infrared-ray radiant portion and reflected by a detection object, refers to the ambient temperature (self temperature), and obtains temperature data corresponding to the temperature of the detection object.

The first and second ambient temperature detection portions 17*a*, 17*b*, substrate portion 17*c*, thermopile portion 17*d*, and ASIC portion of the thermopile type temperature sensor are protected from the heat generated by the heat roller 3 by an outer package structure although not described in detail. A part of the thermopile type temperature sensor, especially a part of the substrate portion 17*c* and the ASIC portion may be separately prepared in a position distant from the heat roller 3 or outside the fixing apparatus 1 in order to secure resistance to the heat generated by the heat roller 3. At least the ASIC portion may be disposed via an insulating material or an outer cover, which is not described in detail, disposed between the portion and the heat roller 3 in order to secure the resistance to the heat generated from the heat roller 3.

Figure 5:
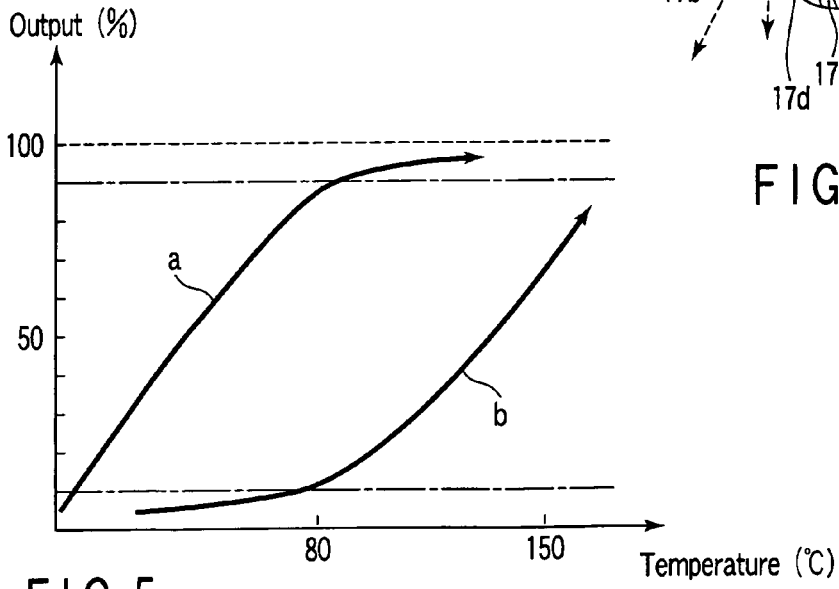
FIG. 5 is a schematic diagram showing an output characteristic of the temperature detection mechanism (non-contact) shown in FIG. 4.

As shown in FIG. 5, the first and second ambient temperature detection portions 17*a*, 17*b* inform detected atmospheric (ambient) temperature by one of a first output characteristic A or a second output characteristic B which is different from the first output characteristic. Boundary temperature is arbitrarily defined by the characteristics of the respective temperature detection portions 17*a*, 17*b*.

The respective temperature detection portions 17*a*, 17*b* output an electric signal corresponding to the detected temperature, that is, temperature data. When the temperature detection mechanism 17 integrally has the ASIC portion, a voltage value (converted temperature data) corresponding to the detected temperature is output. The temperature data output by the first and second temperature detection portions 17*a*, 17*b* are utilized in specifying self temperature which is temperature of a predetermined position in the fixing apparatus 1. The self temperature is used in specifying the temperature of the surface of the heat roller 3 together with a roller temperature detection signal which is an infrared-ray detection value output from the infrared-ray detection portion of the thermopile portion 17*d*.

The roller temperature detection signal (infrared-ray detection value) output from the thermopile portion 17*d* is output as the temperature data of the surface of the heat roller 3 to the outside or an output terminal (not shown) together with one of the temperature data corresponding to the self temperatures output from two ambient temperature detection portions 17*a*, 17*b*.

When the thermopile type temperature sensor 17 integrally has the ASIC portion, the temperature of the surface of the heat roller 3 is output as a voltage value (converted temperature data) indicating the temperature to the outside or the output terminal (not shown).

Figure 6:
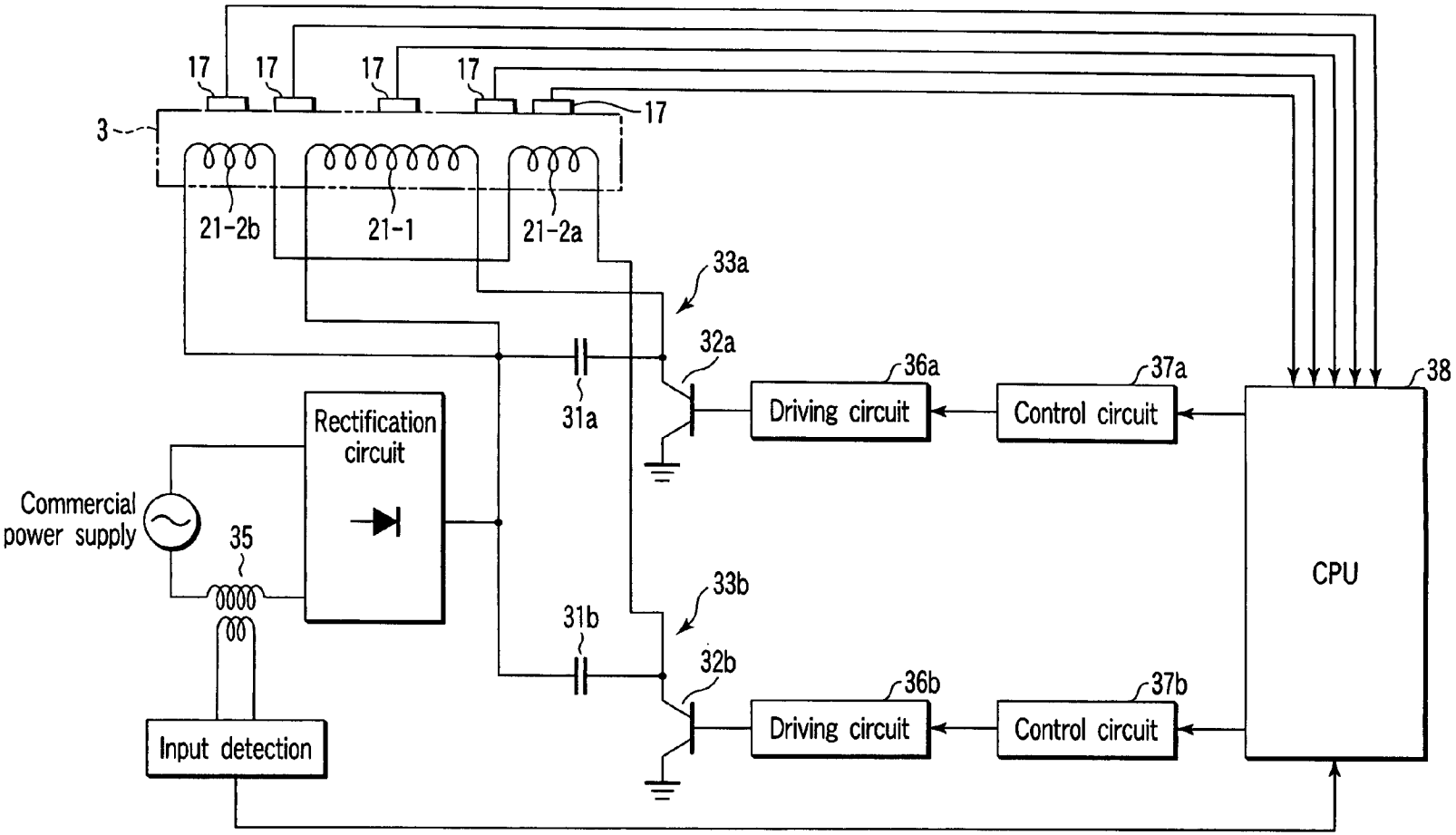
FIG. 6 is a schematic diagram showing one example of a driving circuit (temperature control circuit) which operates the fixing apparatus shown in FIGS. 1 and 2 (or 3)

FIG. 6 shows one example of a driving circuit (temperature control circuit) which operates the fixing apparatus shown in FIGS. 1 and 2.

The middle coil 21-1 and the end coil 21-2 (the first end coil 21-2*a* and the second end coil 21-2*b* connected in series are treated as one coil) of the heating device 7 are connected in parallel with capacitors 31*a*, 31*b* for resonance. A set of the first coil 21-1 and the capacitor 31*a*, and a set of the second coil 21-2 and the capacitor 31*b* are connected to switching elements 32*a*, 32*b*. In the individual switching elements 32*a*, 32*b*, for example, an insulated gate bipolar transistor (IGBT) capable of supplying a current, for example, of about 100 amperes (A), an electric field transistor (MOS-FET) and the like are usable.

A first inverter circuit 33*a* is defined by the middle (first) coil 21-1, capacitor 31*a*, and switching element 32*a*, and a second inverter circuit 33*b* is defined by the end (second) coil 21-2, capacitor 31*b*, and switching element 32*b*.

A direct current which is rectified by a rectification circuit 34 and whose ripple content is smoothed into a predetermined magnitude is supplied to the individual inverter circuits 33*a*, 33*b*. The rectification circuit 34 is connected to a commercial alternating-current power supply. A transformer 35 capable of detecting all power consumption by the heating device 7 (first coil 21-1, second coil 21-2) is disposed in a stage previous to the rectification circuit 34.

Control terminals of the switching elements 32*a*, 32*b* are connected to driving circuits 36*a*, 36*b* which turn on the individual switching elements at predetermined timings. Each of the driving circuits 36*a*, 36*b* applies a predetermined driving voltage to the control terminal of the corresponding switching element. An operation timing of the driving circuit 36*a* or 36*b*, that is, a timing at which the driving voltage is applied to the control terminal of the corresponding switching element 32*a* or 32*b* from the driving circuit 36*a* or 36*b* is instructed by a control circuit 37*a* or 37*b*. The control circuits 37*a*, 37*b* instruct a frequency in a range, for example, of 20 to 60 kHz to the driving circuits 36*a*, 36*b*. When the driving voltages having predetermined frequencies are supplied from the driving circuits 36*a*, 36*b*, the inverter circuits 33*a*, 33*b* defined including the switching elements 32*a*, 32*b* are repeatedly turned on in accordance with the supplied frequencies. When the inverter circuits 33*a*, 33*b* are repeatedly turned on in accordance with the supplied frequencies, currents having predetermined magnitudes are supplied to the first coil 21-1 and second coil 21-2 in the inverter circuits 33*a*, 33*b*. The magnitude of the current is defined in accordance with the magnitude of the heat to be generated by the heat roller 3. In other words, the magnitude of the heat generated by the heat roller 3 depends on the frequency instructed from the control circuits 37*a*, 37*b*.

The heat generated from the heat roller 3 is detected for each position of the temperature detection mechanism 17 in the longitudinal direction of the heat roller 3 by the non-contact temperature detection means, that is, the temperature detection mechanism 17. Temperature information of an arbitrary position of the heat roller 3 in the longitudinal direction detected by the temperature detection mechanism 17 is input into a temperature control CPU 38. When the structure of the temperature detection mechanism 17 separately requires the ASIC portion, a temperature detection circuit is disposed between the mechanism and the temperature control CPU 38. When a contact type temperature sensor (not shown) is disposed besides or inside the temperature detection mechanism 17, its output signal (temperature data) is also input into the temperature control CPU 38.

The temperature control CPU 38 specifies an inverter circuit to be turned on and the frequency to be supplied referring to temperature information input from each temperature detection mechanism 17 and quantity of heat required in the heat roller 3 and/or the temperature distribution in the longitudinal direction of the heat roller 3.

The specified frequencies are input into the driving circuits 36*a*, 36*b* via the control circuits 37*a*, 37*b*. The driving voltage having the frequency specified by the temperature control CPU 38 is supplied to the control terminal of the corresponding switching element 32*a*, 32*b* from the driving circuit 36*a*, 36*b*. Therefore, the quantity of heat required for the heat roller 3 and/or the temperature distribution in the longitudinal direction of the heat roller 3 are optimized based on the size of the sheet to be fixed.

In the fixing apparatus shown in FIGS. 1 and 2 and the driving circuit shown in FIG. 6, an example in which two (sets of) coils are disposed has been described, but the number of (the sets of) the coils may be arbitrarily set, and three (sets) or more may be disposed. The temperature detection mechanisms 17 are preferably increased in accordance with the number of the coils. As to at least the number of the coils required, the number of the sets of the coils is added to the number of the coils.

Next, one example of temperature control for setting the temperature of the heat roller will be described in association with the output characteristic of the thermopile type temperature sensor.

As described above with reference to FIG. 4, the temperature detection mechanism, that is, the thermopile type temperature sensor 17 has the first and second ambient temperature detection portions 17*a*, 17*b*. Each of the ambient temperature detection portions 17*a*, 17*b* informs the temperature control CPU 38 (see FIG. 6) of the detected (atmospheric) temperature by one of the first output characteristic A and the second output characteristic B which is different from the first output characteristic.

In the first output characteristic A, as shown by a curved line a in FIG. 5, the output reaches 90% of an output range at an atmospheric temperature of 80° C. In other words, when the atmospheric temperature is higher than 80° C., the output does not necessarily reflect the atmospheric temperature. This characteristic (output characteristic A) does not change, even when the temperature information output by the first ambient temperature detection portion 17*a* is an electric signal (current value) corresponding to the temperature, for example, even when the ASIC portion is integrally formed and the information is a voltage value.

In the second output characteristic B, as shown by a curved line b in FIG. 5, the output reaches 90% of an output range at an atmospheric temperature of 120° C. In other words, when the atmospheric temperature is lower than 120° C., the output does not necessarily reflect the atmospheric temperature. Especially, when the atmospheric temperature is 80° C. or less, the output is substantially constant. This characteristic (output characteristic B) does not change, even when the temperature information output by the second ambient temperature detection portion 17*b* is an electric signal (current value) corresponding to the temperature, for example, even when the ASIC portion is integrally formed and the information is a voltage value.

It is to be noted that when the atmospheric temperature is at 120° C., the temperature of the detection object, that is, the temperature of the surface of the heat roller 3 is substantially at 200° C.

Figure 7:
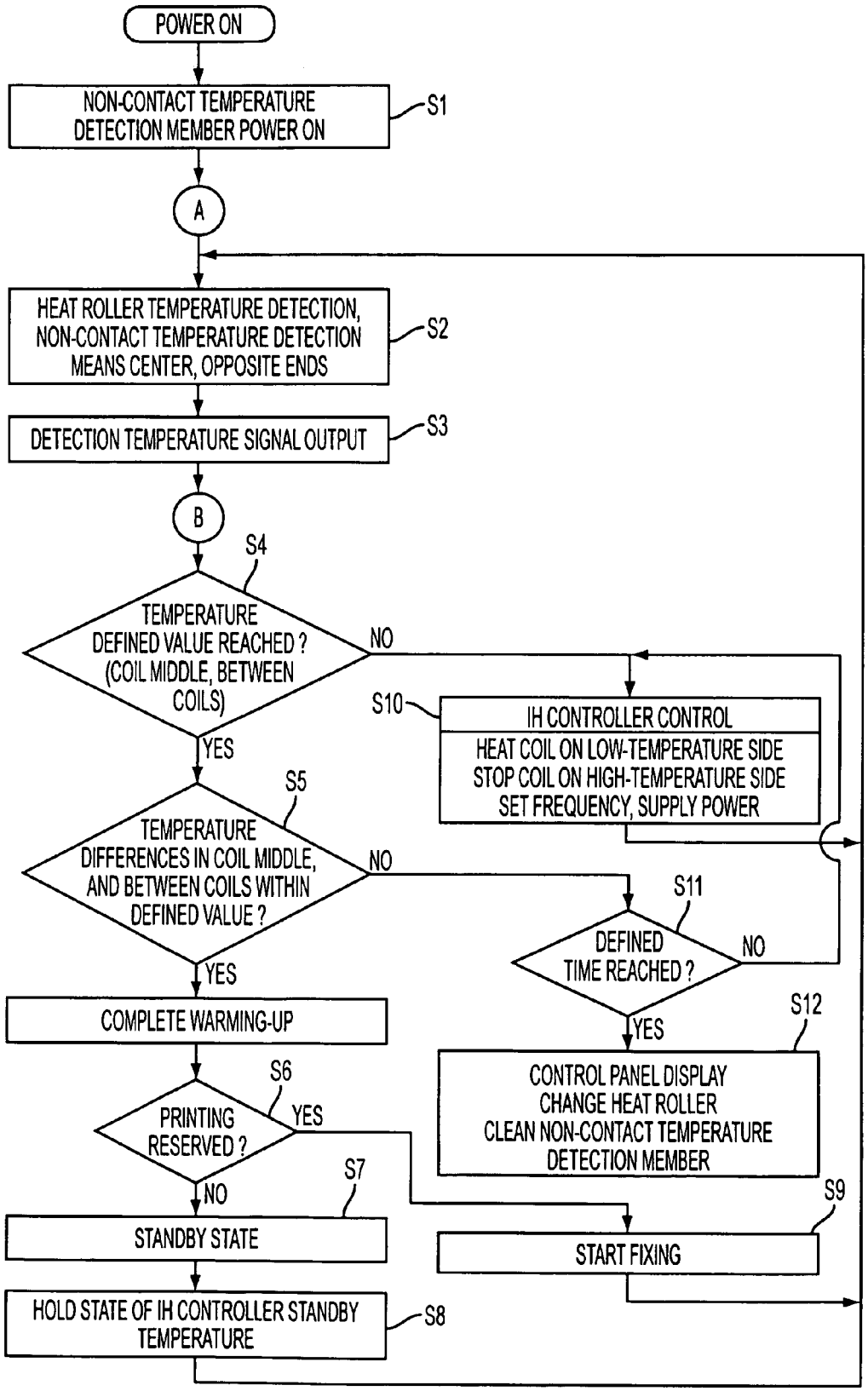
FIG. 7 is a schematic diagram showing one example in which temperature of a heat roller of the fixing apparatus shown in FIGS. 1 and 2 is set by the driving circuit shown in FIG. 6 utilizing an output of the temperature detection mechanism shown in FIG. 4.

FIG. 7 shows an example in which the temperature of the heat roller of the fixing apparatus shown in FIGS. 1 and 2 is set by the driving circuit shown in FIG. 6 utilizing the output of the thermopile type temperature sensor (temperature detection mechanism, hereinafter referred to as the temperature sensor) 17.

When an image forming apparatus (not shown) is started, all temperature sensors 17 are turned on. Moreover, the power having a predetermined frequency is supplied to all the first and second coils (S1).

First temperature data (self temperature), second temperature data (self temperature), and roller temperature detection signal (infrared-ray detection value) are output from the first ambient temperature detection portion 17*a*, second ambient temperature detection portion 17*b*, and thermopile portion 17*d* of each temperature sensor 17. It is to be noted that when a contact type thermistor is disposed (in each temperature sensor 17), an output of the contact type thermistor is usable in the detection of the self temperature (S2).

When the temperature sensor integrally has the ASIC portion, a detected temperature signal indicating the temperature of the surface of the heat roller 3 corresponding to the position of each temperature sensor 17 is obtained from the first temperature data (self temperature), second temperature data (self temperature), and roller temperature detection signal (infrared-ray detected value) (S3). When the temperature sensor is separated from the ASIC portion, in many cases, the detected temperature signal indicating the temperature of the surface of the heat roller 3 corresponding to the position of each temperature sensor 17 is obtained by a temperature detection circuit (not shown) disposed in a stage previous to the temperature control CPU 38.

It is judged by the temperature control CPU 38 whether or not the temperature of the surface has reached reference temperature concerning all regions in the longitudinal direction (axial direction, i.e., main scanning direction) of the heat roller 3 based on the detected temperature signal. It is also judged whether or not the temperature has reached the reference temperature concerning the peripheral direction of the heat roller 3. An order in which the temperature data (detection signal) is output can be arbitrarily set. It is also possible to set a latching timing on the side of the temperature control CPU 38 (S4).

When it is detected that the temperature of the surface of the heat roller 3 has reached the reference temperature in step S4 (S4-Yes), it is judged by the temperature control CPU 38 whether or not a difference between the temperature in the region where the temperature is raised by the first coil 21-1 and that in the region where the temperature is raised by the second coil 21-2 is in a predetermined range. If necessary, temperature unevenness (ripple) in the peripheral direction of the heat roller 3 is also judged (S5).

When the temperature difference on the surface of the heat roller 3 is within the predetermined range in the step S5 (S5-Yes), it is checked whether or not printing (output) is reserved (S6).

When the printing (output) is not reserved in the step S6 (S6-No), "standby routine" is executed (S7), and "standby control routine" for holding the temperature of the surface of the heat roller 3 at "standby temperature" is executed (S8).

When the printing (output) is reserved in the step S6 (S6-Yes), the sheet S to which a toner image has been transferred is supplied to the nip N between the heat roller 3 and the press roller 5 subsequently to "printing operation (image forming step)", and "fixing step" of fixing the toner to the sheet S starts (S9).

When it is detected in the step S4 that the temperature of the surface of the heat roller 3 does not rise at the reference temperature (S4-No), "temperature raising routine (warming-up)" is executed. That is, the power having the predetermined frequency is continuously supplied to all the coils (S10).

When the temperature difference of the surface of the heat roller 3 is larger than a predetermined magnitude in the step S5 (there is a ripple, i.e., temperature unevenness) (S5-No), it is checked whether or not a time until the temperature of the region where the temperature is raised by one of the coils reaches the reference temperature is within a defined time (S11).

It is detected in the step S11 that the time until the temperature of the region where the temperature is raised by one of the coils reaches the reference temperature is within the defined time although there is temperature unevenness in the temperature of the surface of the heat roller 3 (S11-No). In this case, the "temperature raising routine (warming-up)" of the step S10 is executed. In this case, the power having the predetermined frequency is supplied to the coil capable of heating the region where the temperature of the surface of the heat roller 3 is low.

Figure 8:
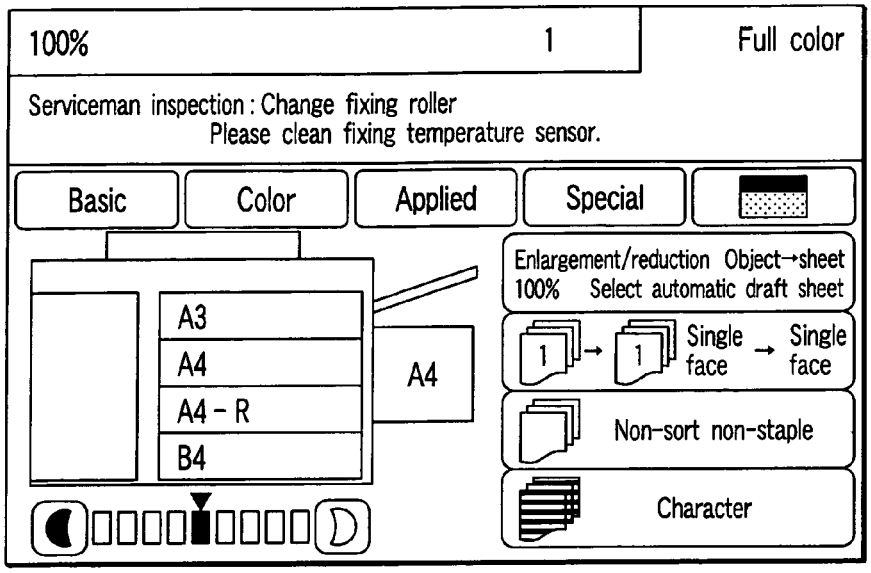
FIG. 8 is a schematic diagram showing one example of display shown in a display section in a step of setting the temperature, shown in FIG. 7.

In the step S11, the time until the temperature of the region where the temperature is raised by one of the coils on the surface of the heat roller 3 reaches the reference temperature exceeds the defined time (the temperature does not rise within the defined time) (S11-Yes). In this case, it is judged that "the surface of the heat roller 3 is deteriorated". In this case, in a display section of the image forming apparatus, for example, as shown in FIG. 8, a message urging maintenance such as "change heat roller/clean temperature sensor" is displayed (S12).

It is to be noted that when "standby routine" is set in the step S7, the temperature of the surface of the heat roller 3 is maintained at a first standby temperature which can be restored at a temperature at which printing-out is possible in a predetermined time for a constant time even in a case where reservation for the printing (output) is input in the step S6. When the temperature of the surface of the heat roller 3 is maintained at the first standby temperature, in the same manner as in the step S5, the powers having the predetermined frequencies are continuously supplied independently or simultaneously to the first and second coils in such a manner that temperature unevenness (ripple) is within a predetermined range in the longitudinal direction of the heat roller 3. It is to be noted that the powers may be non-continuously supplied to the individual coils based on the output of the temperature sensor 17 (the supplying of the powers to all the coils is sometimes stopped with a change of the frequency of the supplied power in order to prevent the temperature of the surface of the heat roller 3 from being raised at the first standby temperature).

When the reservation for the printing (output) is input in the step S6, and the "fixing step" is executed in the step S9, the coil to which the power is supplied, the time for which the power is supplied, or the frequency of the power is sometimes changed in accordance with the size of the sheet S. For example, when the length (width) of the image forming region is shorter than that of the heat roller 3, the time for which the power is supplied to the second (end) coil 21-2 is set to be short as compared with the time for which the power is supplied to the first (middle) coil 21-1. The time for which the power is supplied to the individual coils is set to be constant, and the frequency to be supplied may be changed for each coil (a case where level of interference sound generated depending on the difference of the frequency is in a predetermined range).

On the other hand, when larger heat is absorbed at a fixing time as compared with a usual sheet S, the powers supplied to the arbitrary/all coils are increased based on the outputs of the individual temperature sensors 17 (the frequency is changed). For example, when the toners corresponding to a plurality of colors decomposed based on subtractive primaries are in a stacked state, or when an output medium is thick, the powers are increased.

It is to be noted that when the "fixing step" of the step S9 is continuous printing outputs and the like, and the atmospheric temperature in the fixing apparatus reaches temperature higher than 80° C., the output of the first ambient temperature detection portion 17*a* of the temperature sensor 17 exceeds 80° C. At this time, the temperature of the heat roller 3 is calculated from the output of the second ambient temperature detection portion 17*b* whose output characteristic indicates a high temperature follow-up property in a case where the atmospheric temperature is higher than 80° C., and the output from the thermopile portion 17*d*. That is, the output from the detection portion having a high follow-up property of the output characteristic with respect to the atmospheric temperature is utilized in accordance with the temperature (temperature to be detected) which is a detection object. In other words, the thermistor utilized in inputting the atmospheric temperature or the temperature signal for calculating the temperature of the detection object from the output detected by the thermopile portion 17*d* is changed based on the atmospheric temperature.

Moreover, in a case where a predetermined time elapses from when the surface of the heat roller 3 is maintained at the first standby temperature, or a predetermined time elapses after the "fixing step" of the step S9 ends, the surface of the heat roller 3 is maintained at a second standby temperature at which power consumption is smaller than that at the first standby temperature. The second standby temperature is a temperature at which the temperature of the heat roller 3 can be reset at a temperature at which the "fixing step" is executable within a defined time in a case where the powers are supplied to the individual coils at a time when the printing (output) is instructed. Needless to say, the powers to be supplied to the individual coils are controlled based on the temperature or the temperature signal of the heat roller 3 output from the temperature sensor 17. The coil to which the power is supplied, or the frequency of the power supplied to the coil is also changed in accordance with the detected temperature. It is to be noted that when the second standby temperature is continued, and accordingly the atmospheric temperature in the fixing apparatus drops below 80° C., the temperature of the heat roller 3 is calculated from the output from the first ambient temperature detection portion 17*a* whose output characteristic indicates a high temperature follow-up property at the atmospheric temperature of 80° C. or less, and the output from the thermopile portion 17*d*. That is, the output from the detection portion whose output characteristic with respect to the atmospheric temperature has a high follow-up property is utilized in accordance with the temperature (temperature to be detected) of the detection object. In other words, the thermistor utilized in inputting the atmospheric temperature for calculating the temperature of the detection object from the output detected by the thermopile portion 17*d*, or the temperature signal is changed based on the atmospheric temperature.

Figure 9:
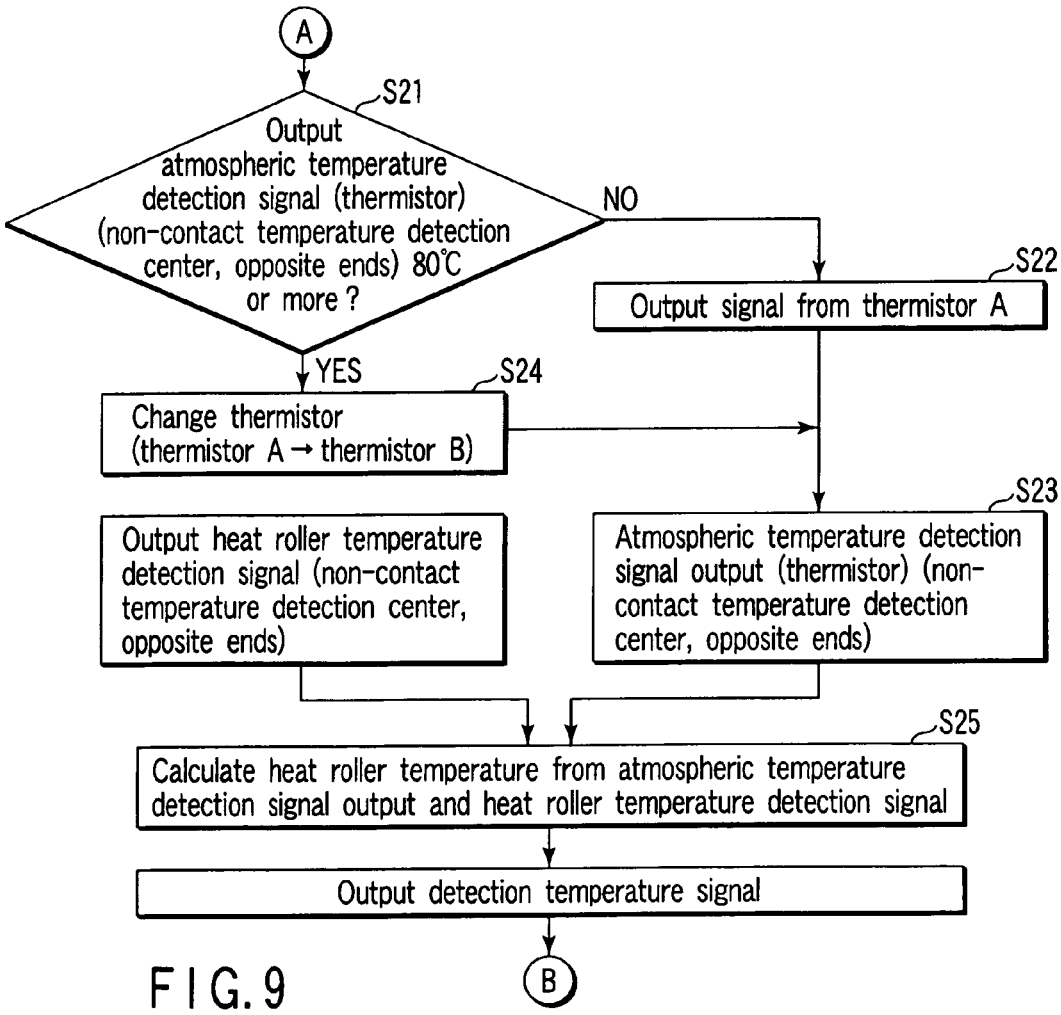
FIG. 9 is a schematic diagram showing one example of temperature control effectively utilizing the output characteristic shown in FIG. 5 in the step of setting the temperature shown in FIG. 7.

FIG. 9 shows one example of temperature control effectively utilizing the characteristic of the thermopile type temperature sensor described above in a flow for setting the temperature of the heat roller of the fixing apparatus shown in FIG. 7.

After all the temperature sensors 17 are turned on in the flowchart shown in FIG. 7, as a sub-routine A, it is checked whether or not the atmospheric temperature detected by the individual temperature sensors 17 is higher than boundary temperature, that is, "80° C." in any sensor. The boundary temperature of "80° C." is, needless to say, arbitrarily set in accordance with the characteristic of the temperature sensor, and may be, for example, either 85° C. or 75° C. (S21). It is to be noted that as the boundary temperature, a specific condition such as a melting point of the toner may be used. For example, the roller temperature detection signal (infrared-ray detected value) obtained by the thermopile portion 17*d* corresponds to comparatively high temperature such that the temperature of the surface of the heat roller 3 already exceeds the melting point of the toner. In this case, it can be judged that the atmospheric temperature in the fixing apparatus is higher than the boundary temperature.

When the detected atmospheric temperature is "80° C. or less" in any sensor (S21-No), the first temperature data (output characteristic A) output from the first ambient temperature detection portion 17*a* is selected (S22), and utilized as "atmospheric temperature (self temperature)" in the fixing apparatus (S23).

When the detected atmospheric temperature is "higher than 80° C." in a certain sensor (S21-Yes), the second temperature data (output characteristic B) output from the second ambient temperature detection portion 17*b* is selected (S24), and utilized as "atmospheric temperature" in the fixing apparatus defined in S23.

The temperature detection portion which outputs the temperature data for use in the "atmospheric temperature" in the fixing apparatus in step S22 or S24, and accordingly a detected temperature signal indicating the temperature of the surface of the heat roller 3 corresponding to the position of each temperature sensor 17 is obtained from the roller temperature detection signal (infrared-ray detected value) obtained by the thermopile portion 17*d* and the selected "atmospheric temperature" (S25).

As described above, in one embodiment of the present invention, when calculating the detection object temperature of the heating object based on the detected value (voltage value) from the temperature which is a target and the output value of the thermistor which detects the atmospheric temperature of a place where the non-contact temperature detection mechanism (thermopile type temperature sensor) is disposed, the output value (voltage value) of the thermistor reaches a defined value. In this case, the output value (voltage value) from the thermistor prepared beforehand and having another temperature characteristic (output characteristic) is regarded as the atmospheric temperature (self temperature) at which the thermistor is disposed. The temperature of the heating object is obtained by the output value and the infrared radiation from the heating object.

In detail, the thermistors for at least two (a plurality of) systems are prepared.

The outputs from the plurality of prepared thermistors are not simultaneously used in detecting the temperature of the object. For example, when targeted temperature is in a first temperature range (e.g., 80° C. or less), one of two thermistors is capable of finely outputting its output value in the temperature range of an atmospheric temperature of 80° C. or less (a temperature follow-up property is high in the output characteristic A). When the targeted temperature is in a second temperature range (e.g., higher than 80° C.) that is higher than the first temperature range, the other thermistor is capable of finely outputting its output value in the temperature range that is higher than an atmospheric temperature of 80° C. (the temperature follow-up property is high in the output characteristic B). Especially, in the second temperature range, the atmospheric temperature is, for example, at about 120° C., and the temperature (temperature to be detected) which is the object of the detection by the thermopile portion 17*d* is 150° C. to 190° C. The output values of both the heat rollers can be switched at a boundary temperature of, for example, 80° C.

In other words, when the temperature control CPU 38 detects the temperature of the surface of the heat roller 3, two or more thermistors (temperature sensors) are capable of providing the self temperature adopted by the CPU 38. The temperature at which the temperature characteristic (output characteristic) of the temperature sensor largely fluctuates is, for example, 80° C., the temperature is regarded as a boundary, and the thermistor supplying the self temperature adopted by the CPU 38 to the CPU 38 is switched.

When the temperature sensor is separate from the ASIC portion, in many cases, a detected temperature signal indicating the temperature of the surface of the heat roller 3 corresponding to the position of each temperature sensor 17 is obtained by a temperature detection circuit (not shown) disposed in a stage previous to the temperature control CPU 38.

The thermopile portion 17*d* of each temperature sensor 17 is capable of detecting the temperatures of a plurality of positions on the outer periphery of the heat roller 3, and the output timing can be arbitrarily set (the temperature may be detected simultaneously or with a time difference (the temperature in the arbitrary position may be detected in a predetermined order)). It is to be noted that when a power supply of an image forming section (not shown) is turned on, a predetermined voltage is supplied to the temperature sensor 17 from the side of the image forming section, and the temperature of the heat roller 3 in a non-control state is detected. Detection places are all positions detectable by all the temperature sensors 17.

As described above, according to one embodiment of the present invention:

a) friction or the like by contact with the temperature detection device is prevented from being caused in the fixed image;

b) the ripple (temperature unevenness) of the temperature of the heat roller surface is reduced;

c) the range of the controlled temperature is enhanced (temperature difference is reduced) in the temperature control for the heat roller using the induction heating;

d) traces of temperature changes (ripples) are inhibited from being left (generated) in the fixed image; and e) a warming-up time can be reduced.

Figure 10:
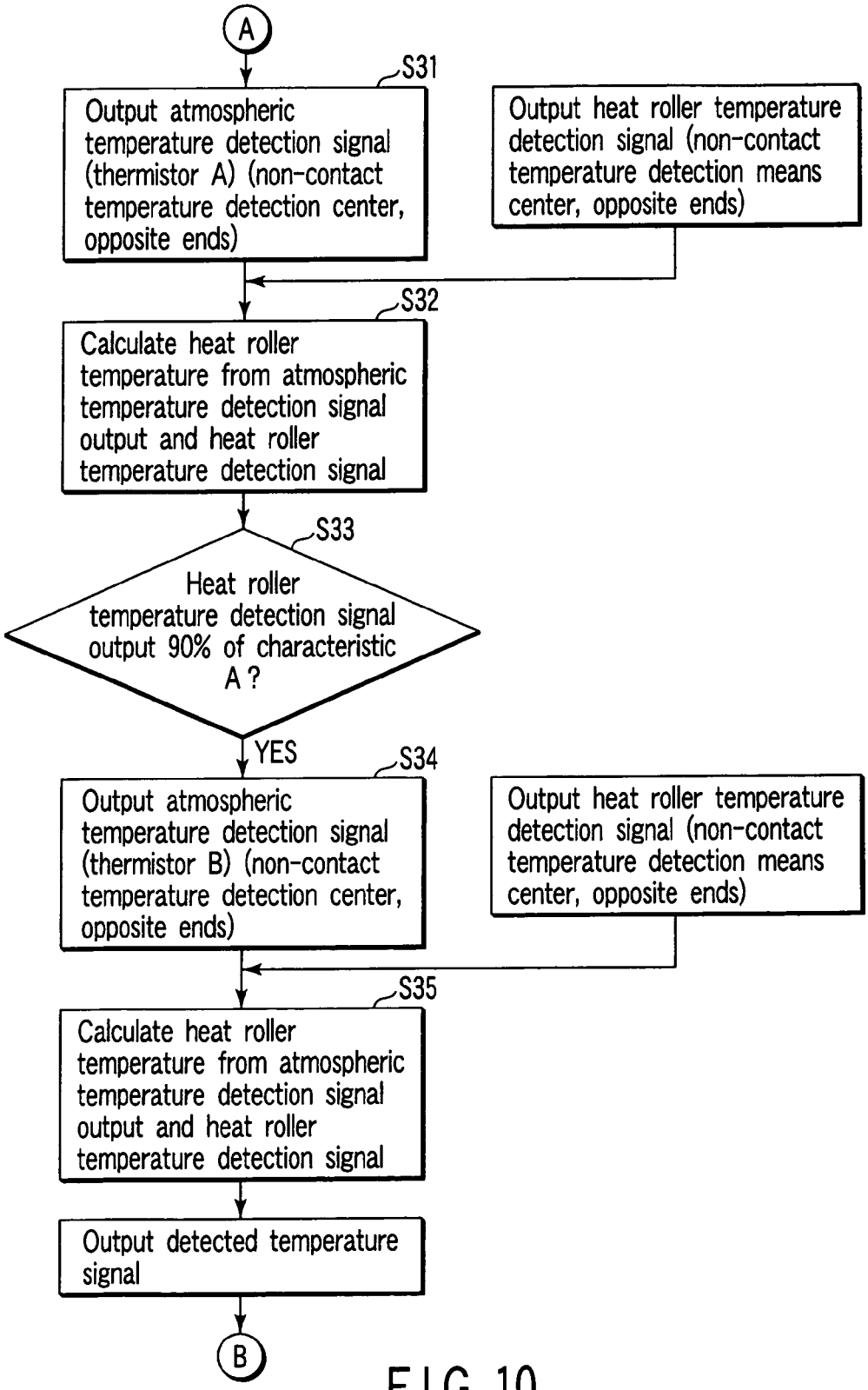
FIG. 10 is a schematic diagram showing another example of the temperature control effectively utilizing the output characteristic shown in FIG. 5 in the step of setting the temperature shown in FIG. 7.

FIG. 10 shows another example of the temperature control effectively utilizing the characteristic of the thermopile type temperature sensor described above in the step of setting the temperature of the heat roller of the fixing apparatus shown in FIG. 7.

In the flowchart described above with reference to FIG. 7, as a sub-routine B, when the atmospheric temperature is lower than predetermined temperature, first temperature data output from the first ambient temperature detection portion 17*a* (having the output characteristic A) having a high follow-up property with respect to the temperature of the detection object is selected (S31). From the data and the roller temperature detection signal (infrared-ray detected value) obtained by the thermopile portion 17*d*, a detected temperature signal indicating the temperature of the surface of the heat roller 3 is obtained (S32).

As to the atmospheric temperature, the first ambient temperature detection portion 17*a* detects the temperature of the detection object to output data, the output data substantially reaches 90% of "output/output range", and at this time second temperature data output from the second ambient temperature detection portion 17*b* is selected. That is, the output is switched to that of the second temperature detection portion 17*b* by the temperature control CPU 38 (see FIG. 6) based on the degree of the output from the first and second ambient temperature detection portions 17*a*, 17*b* which detect the atmospheric temperature in the "output/output range" of the first temperature detection portion 17*a* (S33). In this case, the predetermined powers are supplied to the first and second coils 21-1, 21-2 continuously and/or based on the predetermined temperature control to maintain the surface of the heat roller 3 at the predetermined temperature.

When the atmospheric temperature reaches the predetermined temperature in the step S33, the second temperature data from the second temperature detection portion 17*b* having the output characteristic B in which the follow-up property with respect to the temperature of the detection object is high is selected (S34). From the data and the roller temperature detection signal (infrared-ray detected value) obtained by the thermopile portion 17*d*, the detected temperature signal indicating the temperature of the surface of the heat roller 3 is obtained (S35).

As described above, in the other embodiment of the present invention, the temperature sensor (thermistor) for use in obtaining the detected value (voltage value) of the output characteristic having the high follow-up property with respect to the temperature of the detection object is switched based on the "output/output range with respect to the atmospheric temperature" of each temperature sensor. At this time, the outputs from the plurality of prepared thermistors are not simultaneously used in the detection of the temperature of the object. For example, one of two thermistors is capable of finely outputting its output value, when the atmospheric temperature is in the first temperature range in which the "output/output range" of the targeted temperature substantially reaches 90%, that is, when the atmospheric temperature is not more than the predetermined temperature (the temperature follow-up property is high in the output characteristic A). The other thermistor is capable of finely outputting its output value, when the "output/output range" of the atmospheric temperature is in the second temperature range in which the output of the output characteristic A substantially exceeds 90% of the "output/output range", that is, when the atmospheric temperature is higher than the predetermined temperature (the temperature follow-up property is high in the output characteristic B). Especially, in the second temperature range, the atmospheric temperature is, for example, about 120° C., and the temperature (temperature to be detected) which is the object of the detection by the thermopile portion 17*d* is in a range of 150° C. to 190° C.

In other words, when the temperature control CPU 38 detects the temperature of the surface of the heat roller 3, two or more thermistors (temperature sensors) are capable of providing the self temperature adopted by the CPU 38. The temperature at which the temperature characteristic (output characteristic) of the temperature sensor largely fluctuates is, for example, the temperature at which the output is substantially 90% of the "output/output range" is regarded as a boundary, and the thermistor supplying the self temperature adopted by the CPU 38 to the CPU 38 is switched. It is to be noted that in a case where the melting point of the toner is utilized for specifying the boundary temperature, a ratio of the above-described "output/output range" which is a requirement for the switching to the second ambient temperature detection portion 17*b* is lower than 90%, for example, when the melting point of the toner is about 120° C. (the ratio of the "output/output range" is substantially 60% in an atmospheric temperature range of 50 to 100° C.).

When the temperature sensor is separate from the ASIC portion, in many cases, a detected temperature signal indicating the temperature of the surface of the heat roller 3 corresponding to the position of each temperature sensor 17 is obtained by a temperature detection circuit (not shown) disposed in a stage previous to the temperature control CPU 38.

The thermopile portion 17*d* of each temperature sensor 17 is capable of detecting the temperatures of a plurality of positions on the outer periphery of the heat roller 3, and the output timing can be arbitrarily set (the temperature may be detected simultaneously or with a time difference (the temperature in the arbitrary position may be detected in a predetermined order)). It is to be noted that when a power supply of an image forming section (not shown) is turned on, a predetermined voltage is supplied to the temperature sensor 17 from the side of the image forming section, and the temperature of the heat roller 3 (in a non-control state) is detected. Detection places are all positions detectable by all the temperature sensors 17.

As described above, according to the other embodiment of the present invention:

a) friction or the like by contact with the temperature detection device is prevented from being caused in the fixed image;

b) the ripple (temperature unevenness) of the temperature of the heat roller surface is reduced; and c) the range of the controlled temperature is enhanced (temperature difference is reduced) in the temperature control for the heat roller using the induction heating.

It is to be noted that the above-described thermopile type temperature sensor 17 is used, and the temperature of the surface of the heat roller 3 which is the detection object is obtained from the roller temperature detection signal obtained by the thermopile portion 17*d*. In this case, the use of the output of the first or second temperature detection mechanism portion, that is, the use of the temperature data or the temperature signal output from the first and second temperature detection mechanism portions 17*a*, 17*b* in the temperature control CPU can be distinguished as follows.

For example, "at a continuous copying operation time" when the atmospheric temperature is constantly higher than the boundary temperature, "when it is predictable that the atmospheric temperature is lower than the boundary temperature after elapse of a predetermined time after end of the continuous copying operation or the like, the output from the second temperature detection mechanism having a high temperature follow-up property in a case where the atmospheric temperature is high may be used. It is to be noted that to specify the boundary temperature, for example, the number of times when continuous image forming is repeated (when the sheet is fed) or the like may be used.

On the other hand, "when at least a predetermined time elapses until the atmospheric temperature rises to the boundary temperature" in the fixing apparatus after turning on a main switch of an image forming section (not shown), the output from the first temperature detection mechanism having the high temperature follow-up property in a case where the atmospheric temperature is low.

Moreover, when the temperature of the surface of the heat roller 3 drops to "the second standby temperature", as described above with respect to FIG. 9 or 10, the atmospheric temperature around the first or second temperature detection portion 17*a* or 17*b*, is specified based on the temperature or temperature data output from each temperature detection portion (the "switching step" of each embodiment is executed). It is to be noted that the second standby temperature has been described in association with the main routine of the temperature control of FIG. 7. At the second standby temperature, a predetermined time is required until the temperature returns to a temperature at which the "fixing step" is executable in a case where a standby state further continues "after the elapse of the predetermined time when it is predictable that the atmospheric temperature is lower than the boundary temperature after ending the continuous copying operation" and the powers are supplied to the individual coils at an instruction time for the printing (output).

It is to be noted that another temperature sensor that does not contribute to the surface of the heat roller 3 is disposed integrally with the thermopile type temperature sensor 17 in such a manner that the atmospheric temperature of the position where the temperature sensor 17 is disposed can be detected, it is also possible to specify the temperature detection signal corresponding to the temperature of the detection object adopted by the temperature control CPU.

As described above, according to a method of the present invention in which the temperature of the heat roller of the fixing apparatus is set using the thermopile type temperature sensor:

a) friction or the like by contact with the temperature detection device is prevented from being caused in the fixed image;

b) the ripple (temperature unevenness) of the temperature of the heat roller surface is reduced;

c) the range of the controlled temperature is enhanced (temperature difference is reduced) in the temperature control for the heat roller using the induction heating;

d) traces of temperature changes (ripples) are inhibited from being left (generated) in the fixed image; and e) a warming-up time can be reduced.

Therefore, the power consumption is also reduced. A quality of the toner image formed on a recording material can be enhanced. It is to be noted that in the embodiment of the present invention, an induction heating system has been described as an example of the heating mechanism for raising the temperature of the heat roller, but the heating mechanism is not especially restricted as long as the temperature of the heat roller in the longitudinal direction can be independently controlled.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A heating apparatus, comprising:

a heating member to which energy is supplied to generate heat and to thereby heat a recording material and a developer;

a plurality of heating mechanisms which supply the energy to the heating member and which are disposed in association with a longitudinal direction of the heating member and which selectively allow the heating member to generate the heat in accordance with temperature distribution of the heating member in the longitudinal direction; and a plurality of temperature detection mechanisms each including a thermopile sensor which detects radiated heat reflected from the heating member without contacting the heating member, and which includes (i) at least two temperature detection sections which detect ambient temperatures of each of the thermopile sensors, (ii) a radiation section which radiates infrared rays toward the heating member, and (iii) a detection section which detects the infrared rays reflected from the heating member, the plurality of temperature detection mechanisms being disposed using a region in which the heating member generates the heat as a unit.

2. The heating apparatus according to claim 1, wherein each of the plurality of temperature detection sections include a first detection portion whose output temperature signal has a high temperature follow-up property in atmospheric temperature that is not more than boundary temperature, and a second detection portion whose output temperature signal has a high temperature follow-up property in atmospheric temperature exceeding the boundary temperature.

3. The heating apparatus according to claim 1, wherein each of the plurality of temperature detection sections include: a first detection portion capable of outputting a temperature signal having a high temperature follow-up property until a value of the temperature signal output by the first detection portion reaches a predetermined ratio value in a temperature range in which the first detection portion is capable of outputting the temperature signal; and a second detection portion capable of outputting a temperature signal having a high temperature follow-up property at temperature at which the value of the temperature signal output by the first detection portion reaches the predetermined ratio value or at higher temperature.

4. The heating apparatus according to claim 2, further comprising:

a temperature calculation section which calculates the temperature of the heating member using one of temperature data output from the radiated heat detection section and temperature signals output from the first and second detection portions of the temperature detection section.

5. The heating apparatus according to claim 3, further comprising:

a temperature calculation section which calculates the temperature of the heating member using one of temperature data output from the radiated heat detection section and temperature signals output from the first and second detection portions of the temperature detection section.

6. A fixing apparatus, comprising:

a heating member to which a magnetic field is supplied to generate heat and to thereby heat a recording material and a developer;

a plurality of first and second coil members which supply the magnetic field to the heating member to generate induction heat and which are disposed in a longitudinal direction of the heating member and which are capable of independently supplying the magnetic field;

a plurality of temperature detection mechanisms each including a thermopile sensor which detects radiated heat reflected from the heating member without contacting the heating member, and which includes (i) at least two temperature detection sections which detect ambient temperatures of each of the thermopile sensors, (ii) a radiation section which radiates infrared rays toward the heating member, and (iii) a detection section which detects the infrared rays reflected from the heating member, the plurality of temperature detection mechanisms being disposed using a region in which the heating member generates the heat as a unit; and a pressure supplying member which is brought into contact with the heating member in a predetermined position and which fixes the developer to the recording material passed between the pressure supplying member and the heating member.

7. The fixing apparatus according to claim 6, wherein the first coil member is positioned substantially in a middle of the heating member in the longitudinal direction, and the second coil members are electrically connected to each other, and positioned along the longitudinal direction of the heating member in end portions of the heating member in the longitudinal direction on opposite sides of the first coil member.

8. The fixing apparatus according to claim 7, wherein each of the plurality of temperature detection sections include a first detection portion whose output temperature signal has a high temperature follow-up property in atmospheric temperature that is not more than boundary temperature, and a second detection portion whose output temperature signal has a high temperature follow-up property in atmospheric temperature exceeding the boundary temperature.

9. The fixing apparatus according to claim 7, wherein each of the plurality of temperature detection sections include:

a first detection portion capable of outputting a temperature signal having a high temperature follow-up property until a value of the temperature signal output by the first detection portion reaches a predetermined ratio value in a temperature range in which the first detection portion is capable of outputting the temperature signal; and a second detection portion capable of outputting a temperature signal having a high temperature follow-up property at temperature at which the value of the temperature signal output by the first detection portion reaches the predetermined ratio value or at higher temperature.

10. The fixing apparatus according to claim 7, further comprising:

a temperature control section which supplies a power having a predetermined frequency to at least one of the first and second coil members for a predetermined time and which maintains the temperature of the heating member in the longitudinal direction at temperature in a predetermined temperature difference range in accordance with temperature information output from the respective temperature detection mechanisms.

11. The fixing apparatus according to claim 8, further comprising:

a temperature calculation section which calculates the temperature of the heating member using one of temperature data output from the radiated heat detection section and temperature signals output from the first and second detection portions of the temperature detection section; and a temperature control section which supplies a power having a predetermined frequency to at least one of the first and second coil members for a predetermined time and which maintains the temperature of the heating member in the longitudinal direction at temperature in a predetermined temperature difference range referring to the temperature of the heating member calculated by the temperature calculation section.

12. The fixing apparatus according to claim 9, further comprising:

a temperature calculation section which calculates the temperature of the heating member using one of temperature data output from the radiated heat detection section and temperature signals output from the first and second detection portions of the temperature detection section; and a temperature control section which supplies a power having a predetermined frequency to at least one of the first and second coil members for a predetermined time and which maintains the temperature of the heating member in the longitudinal direction at temperature in a predetermined temperature difference range referring to the temperature of the heating member calculated by the temperature calculation section.

13. A temperature detection apparatus comprising:

a radiant temperature detection section including at least a ray emission portion which radiates at least rays and a ray detection portion which detects the rays, and capable of detecting temperature without contacting a detection object;

a first atmospheric temperature detection section which detects atmospheric temperature of the radiant temperature detection section and which outputs temperature information having a high temperature follow-up property in a case where the atmospheric temperature is not more than predetermined temperature; and a second atmospheric temperature detection section which detects the atmospheric temperature of the radiant temperature detection section and which outputs temperature information having a high temperature follow-up property in a case where the atmospheric temperature exceeds the predetermined temperature.

14. The temperature detection apparatus according to claim 13, wherein the radiant temperature detection section includes a thermopile type temperature sensor.

15. The temperature detection apparatus according to claim 13, further comprising:

a temperature calculation section which calculates the temperature of the detection object using one of temperature information output from the radiant temperature detection section and temperature signals output from the first and second atmospheric temperature detection sections.

16. The temperature detection apparatus according to claim 14, further comprising:

a temperature calculation section which calculates the temperature of the detection object using one of temperature information output from the radiant temperature detection section and temperature signals output from the first and second atmospheric temperature detection sections.

17. The temperature detection apparatus according to claim 16, wherein the second atmospheric temperature detection section outputs the temperature information having the temperature follow-up property at temperature at which the value of the temperature signal output by the first atmospheric temperature detection section reaches a predetermined ratio value or at higher temperature.

18. The fixing apparatus according to claim 6, further comprising:

a controller which controls supplying of the magnetic field to the first and second coil members independently based on a detection value obtained by said each of the temperature detection mechanisms, the controller causing an output for requesting checking of the temperature detection mechanism and/or portions of the heating member which reflect the infrared rays, and which are heated by the first and second coils members, respectively, when a difference between temperatures of the portions of the heating member is greater than a predetermined temperature difference, and is maintained even after a predetermined time period lapses, the difference being determined in accordance with the detection value.

* * * * *